US005729884A

United States Patent [19]

Stephany et al.

[11] Patent Number: 5,729,884

[45] Date of Patent: Mar. 24, 1998

[54] METHOD FOR ASSEMBLING A PRINT HEAD FOR AN ELECTROGRAPHIC PRINTER

[75] Inventors: Thomas M. Stephany, Churchville; William Mey, Rochester; William E. Schmidtmann, Naples, all of N.Y.

[73] Assignee: Eastman Kodak Company, Rochester, N.Y.

[21] Appl. No.: 639,647

[22] Filed: Apr. 29, 1996

[51] Int. Cl.[6] ..... H01K 3/10

[52] U.S. Cl. ..... 29/592.1; 156/215; 156/556; 347/117

[58] Field of Search ..... 29/592.1, 890.1, 29/759; 156/187, 215, 556; 342/112, 115, 117; 399/282, 299

[56] References Cited

U.S. PATENT DOCUMENTS 4,764,445 8/1988 Miskinis et al. .

5,148,595 9/1992 Doggett et al. ..... 29/592.1

FOREIGN PATENT DOCUMENTS 04141459A 5/1992 Japan .

*Primary Examiner*—Carl E. Hall

*Attorney, Agent, or Firm*—Thomas H. Close

[57] ABSTRACT

A method of assembling a print head for an electrographic printer includes the steps of providing a flexible sheet having a microchannel print structure having a longitudinal axis and a plurality of alignment features relative to the longitudinal axis; providing a magnetic brush having a cylindrical axis and an outside shell; providing a fixture having alignment features for aligning the flexible sheet on the outside shell of the magnetic brush such that the longitudinal axis of the microchannel print structure is aligned parallel to the cylindrical axis of the magnetic brush and for conforming the microchannel print structure to the surface of the outside shell; and placing the flexible sheet and the magnetic brush in the fixture and attaching the flexible sheet to the outside shell of the magnetic brush.

5 Claims, 5 Drawing Sheets

METHOD FOR ASSEMBLING A PRINT HEAD FOR AN ELECTROGRAPHIC PRINTER

CROSS REFERENCE TO RELATED APPLICATIONS

Reference is made to U.S. Ser. No. 08/294,294, filed Aug. 23, 1994, entitled "Electrographic Printing Process and Apparatus" by William Mey et al. and to U.S. Ser. No. 08/620,655, filed Mar. 22, 1966, entitled "Microchannel Print-Head for Electrographic Printer", by William Grande et al.

FIELD OF THE INVENTION

The invention relates generally to the field of electrographic printing, and more particularly to a method and fixture for assembling a print head for an electrographic printer and a print head produced by the method.

BACKGROUND OF THE INVENTION

As described in the related patent application, the process of electrographic printing using a microchannel print head involves the direct placement of toner onto a receiver from an individually addressable array of electrodes. These electrodes are physically separated from one another through the use of microchannels which direct a flow of a magnetic developer across a print head. The print head has transfer electrodes within each channel for the transfer of toner to a receiver. The microchannel structure of the print head may be manufactured on a flexible support, such as Kapton brand polyimide tape. The print head is physically attached to the outside shell of the cylindrical magnetic brush, using an adhesive. The magnetic brush comprises a non-rotating shell with a rotatable magnetic core. This arrangement both delivers a flow of developer through the channels and allows a control voltage applied through a transfer electrode to a transfer site which, in turn, transfers toner to a receiver.

For best operation of the above process, a precise control of the gap between the surface of the microchannel print head and the receiver is desirable to achieve a uniform writing density. This is difficult to achieve with a microchannel structure formed on a flexible substrate. It is also desirable to maintain precise alignment of the transfer electrodes in the microchannel print structure of the microchannel print head to the center line of the magnetic brush, which prevents the print head from forming a skewed image. The present invention addresses these concerns in the manufacture of a microchannel print head employing a flexible substrate for supporting the microchannel print structure.

SUMMARY OF THE INVENTION

Briefly summarized, according to one aspect of the present invention, a method of assembling a print head for an electrographic printer includes the steps of providing a flexible sheet having a microchannel print structure having a longitudinal axis and a plurality of alignment features relative to the longitudinal axis; providing a magnetic brush having a cylindrical axis and an outside shell; providing a fixture having alignment features for aligning the flexible sheet on the outside shell of the magnetic brush such that the longitudinal axis of the microchannel print structure is aligned parallel to the cylindrical axis of the magnetic brush and for conforming the microchannel print structure to the surface of the outside shell; and placing the flexible sheet and the magnetic brush in the fixture and attaching the flexible sheet to the outside shell of the magnetic brush.

These and other aspects, objects, features and advantages of the present invention will be more clearly understood and appreciated from a review of the following detailed description of the preferred embodiments and appended claims, and by reference to the accompanying drawings.

ADVANTAGEOUS EFFECT OF THE INVENTION

The flexible microchannel print head produced through the use of the process of the present invention enables high quality images to be produced, using a print head manufactured with common flex circuit technology. The precise alignment of the flexible print head to the curved surface of the magnetic brush, and the minimization of any variation in gap between the transfer electrodes and the receiver, is crucial for obtaining even print density. The print head is fabricated using well known and commonly available photofabrication techniques. The production facilities are common to the circuit board industry, and the print head uses standard flex circuit materials. The alignment and attachment of the flexible print head to the magnetic brush is accomplished through the use of specialized fixturing specifically designed for this purpose.

BRIEF DESCRIPTION OF THE DRAWINGS

To facilitate understanding, identical reference numerals have been used, where possible, to designate identical elements that are common to the figures.

DETAILED DESCRIPTION OF THE INVENTION

Figure 1:
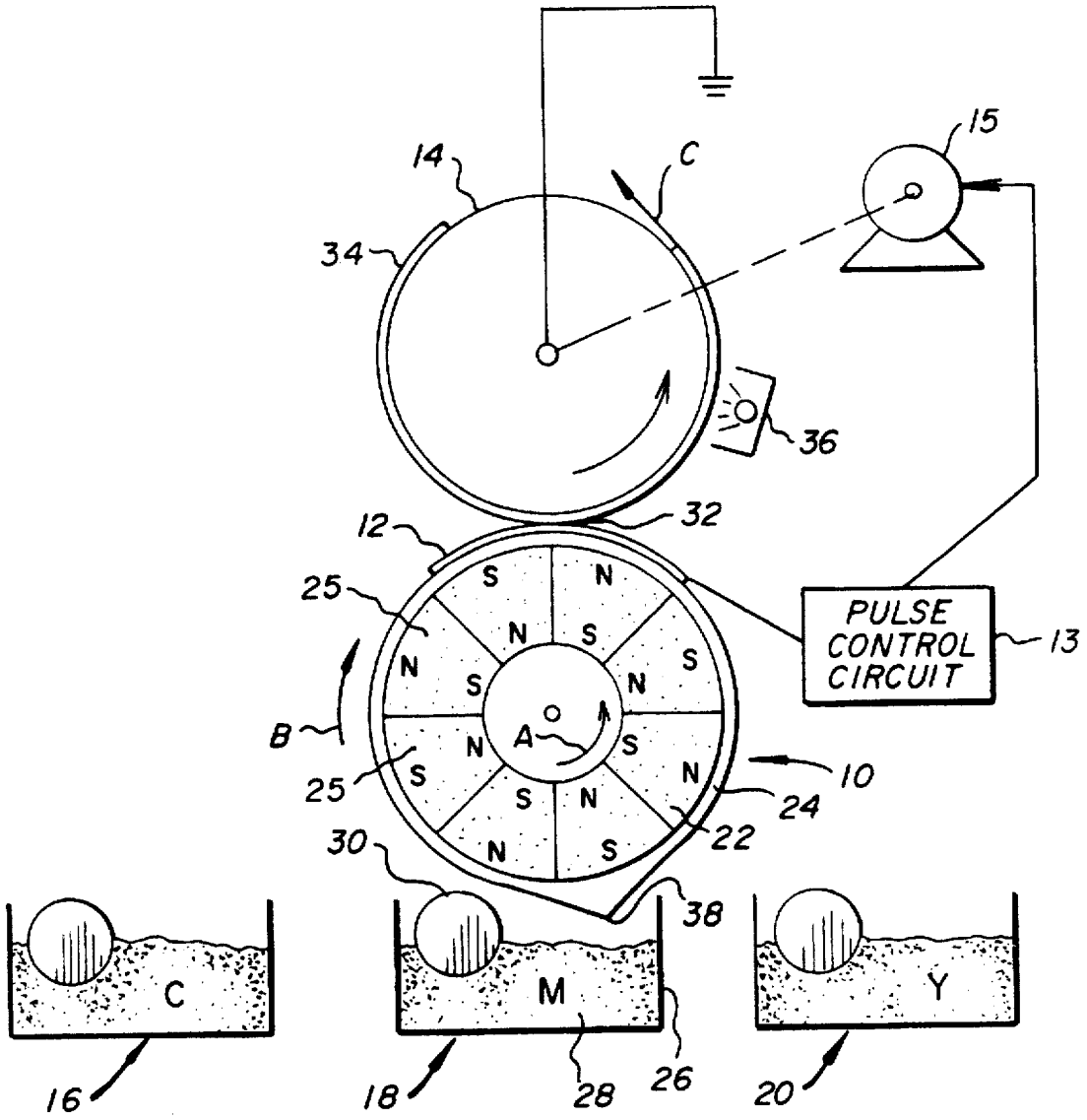
FIG. 1 is a schematic diagram of an electrographic printer employing a flexible microchannel print head assembled according to the present invention.

Beginning with FIG. 1, an electrographic color printer according to the present invention is shown. The printer includes a magnetic brush generally designated 10, a microchannel print head 12 driven by a pulse control circuit 13, a receiver electrode 14 driven by a stepper motor 15, and three developer supplies 16, 18 and 20 for supplying cyan, magenta and yellow developer powder to the magnetic brush 10, respectively. In a printer adapted to print text as well as color images, a fourth developer supply (not shown) for supplying black developer powder to the magnetic brush may be provided. The stepper motor 15 is powered by pulse control circuit 13 to synchronize the printing of the different colored developers.

The magnetic brush 10 includes a rotatable magnetic core 22 and stationary outer cylindrical shell 24 characterized by low magnetic permeability and high electrical conductivity. The rotatable magnetic core includes a plurality of permanent magnetic sectors 25 arranged about and extending parallel to the cylindrical surface of the shell 24 to define a cylindrical peripheral surface having alternating North and South magnetic poles. In operation, the magnetic core 22 rotates in a counter clockwise direction as indicated by arrow A to transport developer around the circumference of shell 24 in a clockwise direction as indicated by arrow B.

Each of the three developer supplies 16, 18, and 20 is constructed in a similar manner and is moveable from a position immediately adjacent the magnetic brush 10 as illustrated by supply 18, to a position away from the magnetic brush as illustrated by supplies 16 and 20 in FIG. 1. Each developer supply includes a sump 26 for containing a supply of magnetic developer 28, for example, a two component developer of the type having an electrically conductive, magnetically attractive carrier and a colored toner. A suitable developer is described in U.S. Pat. No. 4,764,445 issued Aug. 16, 1988, to Miskinis et al. The performance of the system can be optimized by employing the carrier having a balanced conductivity low enough to triboelectrically charge the toner particle, but high enough to conduct electricity. A rotatable magnetic feed roller 30 is actuable for delivering developer 28 from the sump 26 to the magnetic brush 10 in a known manner.

The microchannel print head 12 is mounted on the outer surface of shell 24 opposite receiver electrode 14 to define a recording region 32. A receiver 34, such as dielectric coated or plain paper, is wrapped around the receiver electrode 14 and moved through the recording region 32 in the direction of arrow C with one surface in contact with receiver electrode 14. Alternatively, the direction of the receiver and the flow of developer may be in opposite directions. A fusing station 36 may be provided as is known in the art to fuse the toner image to the receiver 34. The fusing station 36 may comprise for example a radiant heat source or a hot roller.

In operation, a first developer supply, say the magenta supply 18 is moved into position adjacent the magnetic brush 10. The magnetic feed roller 30 is actuated to supply developer 28 to the magnetic brush 10. The developer 28 is transported around the periphery of the magnetic brush 10 to the recording region 32, where pulses are selectively applied to an array of transfer electrodes in the microchannel print head 12 by pulse control circuit 13 to transfer toner from the developer 28 to the receiver 34 in an imagewise manner as the receiver is moved by stepper motor 15 through the recording region 32. After the first color component of the image (e.g. magenta) is formed on the receiver 34, the remaining developer is removed from the magnetic brush 10.

Means are provided on the shell 24 of the magnetic brush 10 such as a lip 38 which extends a distance from the magnetic core 22 so that as the developer is transported around the periphery of the shell 24, it is moved away from the influence of the magnetic core 22 to the point where it falls back into the sump 26. Alternatively, another magnetic brush and sump (not shown) having only magnetic carrier (no toner) may be provided for cleaning. The magnetic carrier is transported around the magnetic brush to scavenge residual toner from the magnetic brush 10 and print head 12. Such an arrangement is called a magnetic brush cleaning station in the prior art.

Next, the developer supply 18 is moved away from the magnetic brush 10 and the next developer supply (e.g. the yellow developer supply 20) is moved into position to replace it. The receiver 34 is repositioned by pulse control circuit 13 and stepper motor 15 to record the yellow component of the image and insure registration between the various color components and the recording process described above is repeated. Finally, the cyan component of the full color image is recorded in a similar fashion. After the three image components are recorded, the full color image is fused to the receiver 34 at fusing station 36. Alternatively, each color developer may be fused after deposition and prior to the deposition of the subsequent color.

Figure 2:
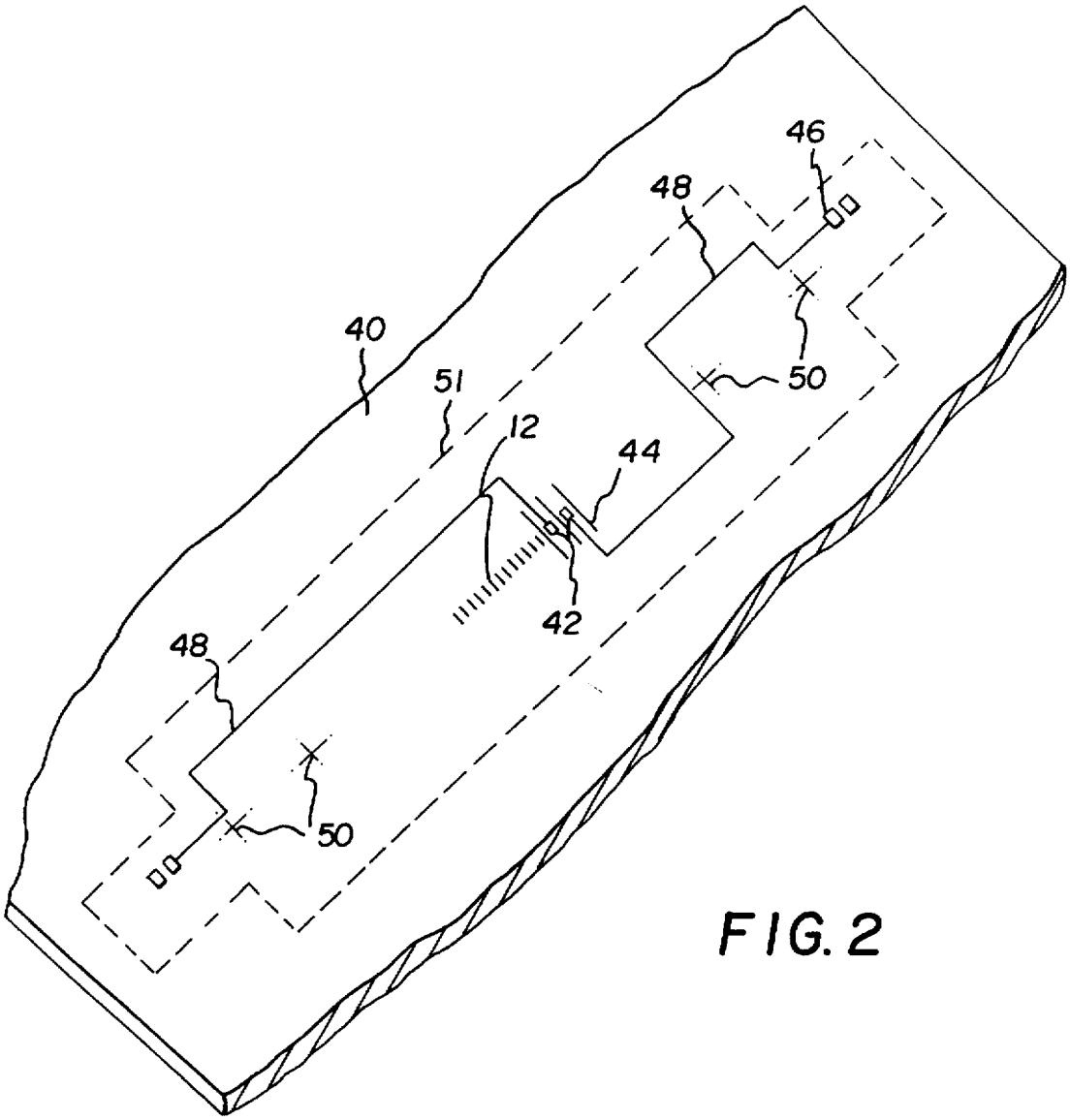
FIG. 2 is a perspective view of a microchannel print structure on a flexible support.

Referring now to FIG. 2, the microchannel print head 12 is formed on a sheet of flexible material 40, such as Kapton brand polyimide tape. The print head 12 includes a row of transfer electrodes 42 in microchannels defined by channel walls 44. The transfer electrodes 42 are electrically connected to circuit pads 46 for mounting pulse control circuits 13 by electrical connectors 48. The transfer electrodes 42 and the electrical connectors 48 are formed on the surface of the Kapton brand polyimide tape 40 by conventional printed circuit manufacturing techniques. The channel walls 44 are formed from solder mask material using conventional printed circuit manufacturing techniques. A plurality of alignment fiducial marks 50 are provided on the print head for indicating the center line of the microchannel print structure transfer electrodes 42. It should be noted that the fiducial marks 50 need not be on the center line, merely in some known relationship thereto. An outline 51 is provided on the sheet 40 for finish trimming of the print head.

Figure 3:
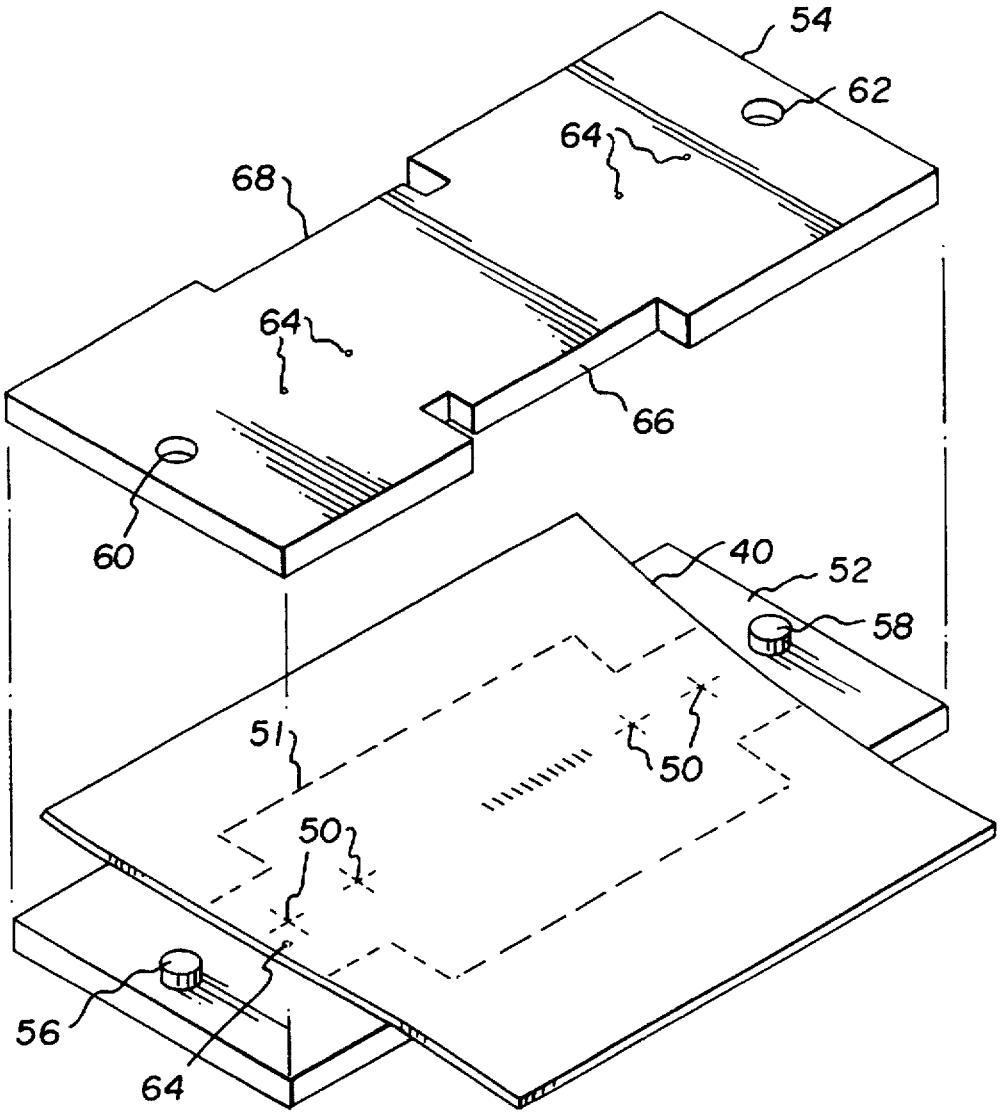
FIG. 3 is a perspective view of a fixture used to form alignment features on the flexible support.
Figure 4:
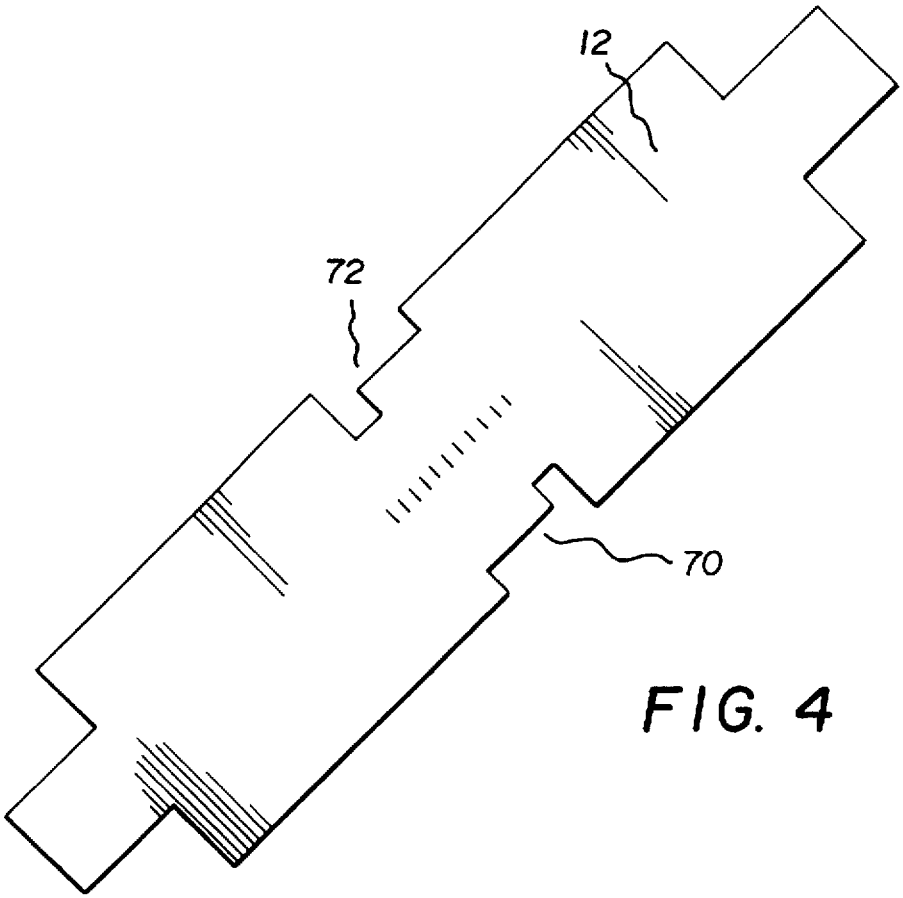
FIG. 4 is a perspective view of the flexible support having alignment features.

Referring to FIG. 3, a fixture for forming alignment features in the sheet 40 includes a bottom plate 52. A top plate 54 is provided for receiving the sheet 40. The bottom plate 52 includes plate alignment pins 56 and 58; and top plate 54 includes plate alignment holes 60 and 62 for receiving plate alignment pins 56 and 58 respectively to align the top plate with the bottom plate. The top and bottom plates also include a plurality of sheet alignment holes 64. The sheet 40 is placed in the fixture and the fiducial marks 50 are aligned with the sheet alignment holes 64. The sheet 40 is then cut using the edges 66 and 68 on the top plate 54 as guides to provide alignment features 70 and 72 (see FIG. 4) on the finished print head. The sheet is then removed from the trimming fixture and cut along the line 51 to achieve the final shape of the print head 12, as shown in FIG. 4.

Figure 6:
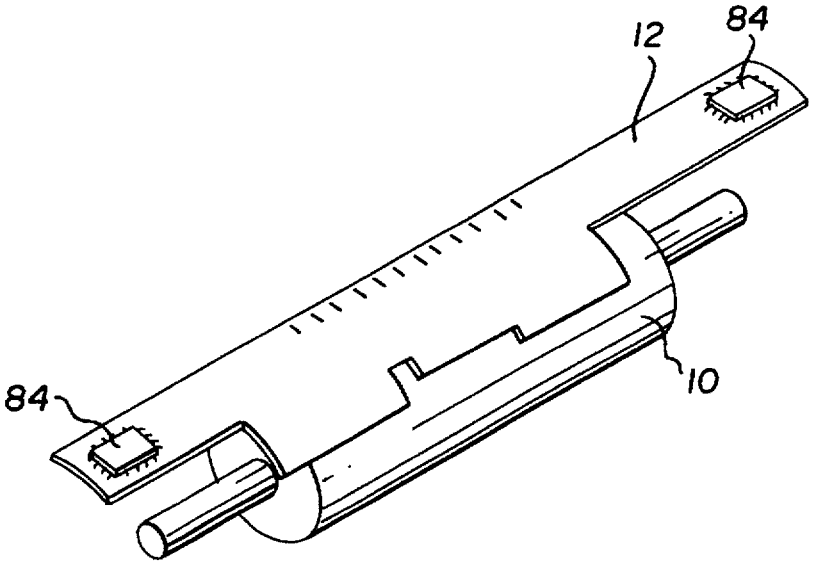
FIG. 6 is a perspective view of a partially assembled microchannel print head.
Figure 5:
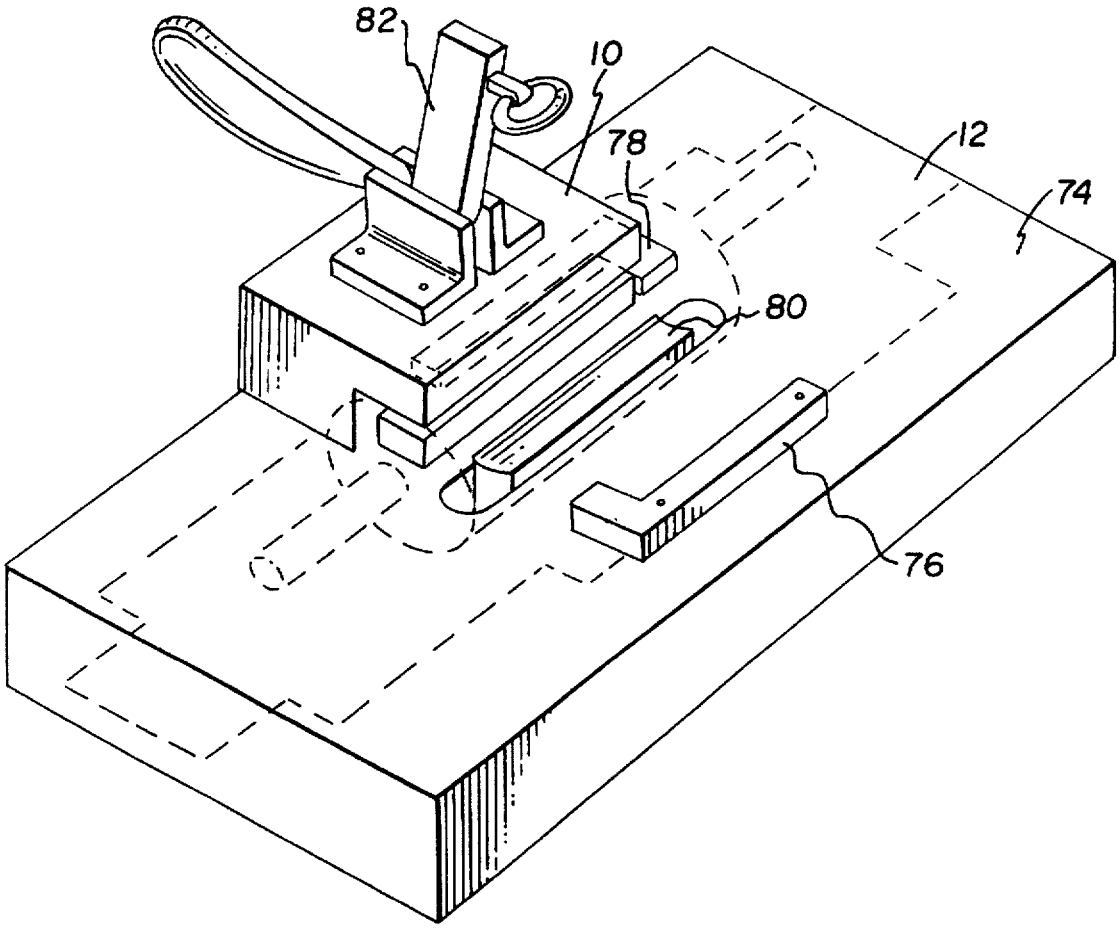
FIG. 5 is a perspective view of a clamping fixture used with the present invention.

Referring to FIG. 5, a fixture 74 includes a pair of alignment features 76 and 78 adapted to cooperate with the alignment features 70 and 72 in a print head 12 (shown in phantom), respectively to align the print head in the fixture 74. The fixture 74 also includes a clamping surface 80 for receiving and aligning a magnetic brush 10 (shown in phantom), and a clamp 82 for urging the magnetic brush 10 into the clamping surface 80. To attach a print head 12 to the magnetic brush 10, the print head 12 is placed upside down in the fixture 74. Adhesive is applied to the underside of the print head 12 and the magnetic brush 10 is placed in the fixture and clamped down onto the print head 12. The alignment features 70 and 72 insure that the print head 12 is aligned with the axis of the magnetic brush 10 and the clamping surface insures that the print head 12 is held flat against the magnetic brush 10. The magnetic brush and print head are removed from the fixture 74, and the remaining portions of the print head are secured to the magnetic brush, for example by adhesive or tape. To complete the print head, electronic circuits 84, such as driver circuits are attached to the mounting pads 46 of the print head 12. The resulting print head 12 attached to a magnetic brush 10 is shown in FIG. 6.

The invention has been described with reference to a preferred embodiment. However, it will be appreciated that variations and modifications can be effected by a person of ordinary skill in the art without departing from the scope of the invention.

We claim:

1. A method of assembling a print head for an electrographic printer, comprising the steps of:

a) providing a flexible sheet having a microchannel print structure having a longitudinal axis and a plurality of alignment features relative to the longitudinal axis;

b) providing a magnetic brush having a cylindrical axis and an outside shell;

c) providing a fixture having alignment features for aligning the flexible sheet on the outside shell of the magnetic brush such that the longitudinal axis of the microchannel print structure is aligned parallel to the cylindrical axis of the magnetic brush and for conforming the microchannel print structure to the surface of the outside shell; and d) placing the flexible sheet and the magnetic brush in the fixture thereby aligning the longitudinal axis of the microchannel print structure parallel to the cylindrical axis of the magnetic brush and conforming the flexible sheet and microchannel print structure to the surface of the outside shell and attaching the flexible sheet to the outside shell of the magnetic brush while so aligned and conformed.

2. The method claimed in claim 1, wherein the alignment features are edge notches in the flexible sheet.

3. The method claimed in claim 2, wherein the edge notches are formed by producing fiducial marks on the sheet during manufacture of the microchannel print structure, placing the flexible sheet in a fixture having complementary fiducial marks for aligning the flexible sheet with cutting guides and cutting the edge notches in the sheet.

4. The method claimed in claim 1, wherein the flexible sheet is polyimide tape.

5. The method claimed in claim 1, wherein the flexible sheet is attached to the magnetic brush with adhesive.

* * * * *